US006422505B1

(12) United States Patent
Froesel

(10) Patent No.: US 6,422,505 B1
(45) Date of Patent: Jul. 23, 2002

(54) PAPER TOWEL HOLDER WITH MEANS FOR FACILITATING ITS APPLICATION AND RELEASE

(76) Inventor: David Wm. Froesel, 49 Whitehall Ct., Brentwood, MO (US) 60144

( * ) Notice: Subject to any disclaimer, the term of this patent is extended or adjusted under 35 U.S.C. 154(b) by 0 days.

(21) Appl. No.: 09/528,019

(22) Filed: Mar. 17, 2000

Related U.S. Application Data

(60) Provisional application No. 60/127,980, filed on Mar. 19, 1999.

(51) Int. Cl.[7] ..... B65H 49/26; B65H 75/08

(52) U.S. Cl. ..... 242/599.1; 242/613.2

(58) Field of Search ..... 242/599.1, 598.3, 242/598.4, 613.2; D6/522, 523

(56) References Cited

U.S. PATENT DOCUMENTS 2,253,664 A * 8/1941 Vigo ..... 242/599.1
2,522,109 A * 9/1950 Foltis ..... D6/523 X
3,239,158 A * 3/1966 Levesque ..... 242/599.1
3,317,099 A * 5/1967 Solomon ..... 242/598.4 X
3,362,653 A * 1/1968 Carlisle ..... 242/599.1
D296,963 S * 8/1988 Smallwood ..... D6/523
5,467,935 A * 11/1995 Moody ..... 242/599.1 X
5,495,997 A * 3/1996 Moody ..... 242/613.2 X
5,727,751 A * 3/1998 Liu ..... 242/599.1
D405,305 S * 2/1999 Hobgood ..... D6/523
D427,828 S * 7/2000 Senecal, Jr. ..... D6/523

* cited by examiner

*Primary Examiner*—Michael R. Mansen
(74) *Attorney, Agent, or Firm*—Paul M. Denk

(57) ABSTRACT

A paper towel holder incorporating structure to facilitate the application and release of a roll of paper towels, including a holder, having a base plate, a pair of perpendicularly mounted end plates secured thereto, a compressible towel roller installs intermediate the end plates, and within their respective counterbores, for holding a roll of paper towels in place during usage. The roller is formed of three segments, a center, left, and right segment, which are compressible with respect to each other, due to the presence of a compression spring within the left segment, against which the middle segment biases when the roller is being contracted in size to allow for its installation intermediate the end plates of the holder.

1 Claim, 4 Drawing Sheets

PAPER TOWEL HOLDER WITH MEANS FOR FACILITATING ITS APPLICATION AND RELEASE

CROSS-REFERENCE TO RELATED APPLICATION

This application is a non-provisional patent application based upon provisional patent application having Ser. No. 60/127,980, filed on Mar. 19, 1999, which is owned by the same inventor.

BACKGROUND OF THE INVENTION

There are a variety of racks, holders, or the like, for use for holding a paper towel roll in place. Many of such holders include a base plate, that secures directly to the wall, and has pivotally hinged end plates, that are spring biased inwardly, so that when they are pulled under a biasing force outwardly, into a perpendicular like direction with the base plate, the paper towel may be slid therein, and once the end plates are released, they bias against and include centering posts for partially inserting within the center roll of the paper towel, to secure the same in place. There are other type holders that are also available in the art, but which require a fair amount of manipulation by the user, and some dexterity through the application of both hands, to secure the paper roll or paper towel roll, in place.

The current invention relates to an improvement in the temporary adherence of a paper towel roll to a rack, and whether the rack be secured to the wall, or simply rested upon a countertop, during its usage and application.

SUMMARY OF THE INVENTION

This invention relates generally to a paper towel holder, and more specifically pertains to a paper towel rack, which incorporates a unique centering roll, which is spring biased, and which includes a hand manipulable lever for facilitating the application and release or removal of the paper towel roll from its supporting holder.

This invention is designed for facilitating the application and holding of a paper towel roll to its holder, and which holder incorporates a base plate, the type that may be fabricated of wood, metal, polymer, or the like, having sufficient support so that it may be rested directly upon the countertop, or it may be secured by means of fastening means, such as screws, directly to the adjacent wall, for support. Likewise, pressure sensitive adhesive means may also be used for attaining such securement. At the ends of the base plate are a pair of perpendicularly extending ends plates, and which are designed having counterbores provided therein, said counterbores from each of the oppositely disposed end plates being arranged in alignment. A manipulable style of spring bias rod means, forms the holder for the towel roll, and this rod means incorporates a lever, at its one end, to facilitate its manipulation, and contraction, so as to allow for ease of insertion of the towel holder in place, and to hold a roll of towels upon this holder, once installed. More specifically, the towel holder includes a base plate, from which a pair of end plates are perpendicularly permanently mounted, and each of the end plates have a counterbore proximate their outer periphery, and into which the roll for the towel holder inserts. The roll for the towel holder includes a series of polymer formed components, but which may obviously be formed from other materials, and has a spanning portion that forms the middle segment of the roll, an outer segment at one end which is permanently affixed thereto, and which includes a lever means that extends radially outwardly, while the opposite end of the roll includes a sleeve, closed at its end, and provides a spring therein, such that when the middle segment of the roller is inserted therein, it becomes spring biased, so that it may be contracted, against the force of the spring, once a roll of towels has been applied thereon, and inserted into the counterbore of one of the end plates, biased inwardly, so as to clear the second end plate, and allow that end of the roll to be arranged within the counterbore of the said end plate, for installation of a roll of towels. All of this manipulation can be done through a grasping and shifting laterally of the roller lever, as can be understood.

It is, therefore, the principal of object of this invention to facilitate the installation and application of a roll of paper or other towels to its holder.

Still another object of this invention is to provide a spring biased roller, for use for holding a roll of towels in place, within its holder.

Still another object of this invention is the provision of lever means, to facilitate the forced contraction against the bias of a spring, when the towel roller is being installed, and allowing for its release when the roller is installed fully within its holder for suspending the roll of towels for ready usage and application.

Yet another object of this invention is to provide a lever at the end of a roller and which may be manipulated inwardly, to contract the length of the roller, when it is desired to remove either the spent of towels from its holder, or for installing a new and full supply roll of towels thereto.

These and other objects may become more apparent to those skilled in the art upon reviewing the summary of this invention, and upon undertaking a study of the description of its preferred embodiment, in view of the drawings.

DESCRIPTION OF THE PREFERRED EMBODIMENT

Figure 1:
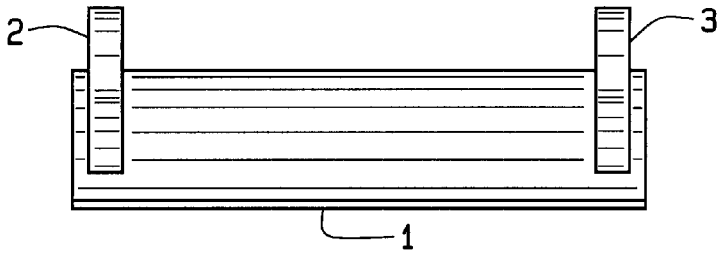
FIG. 1 provides a perspective view of the holder portion of this invention, with a roll of towels and its compressible roller removed therefrom.

In referring to the drawings, and in particular FIG. 1, the towel holder of this invention is disclosed, and comprises a base plate 1, having a pair of end plates 2 and 3, both of which are perpendicularly mounted with respect to the base plate, as can be noted. The base plate, as shown herein, may be fabricated of wood, to enhance the decorative appearance of the holder, or it may be formed of any type of a polymer, metal, or the like, depending upon the attributes of the designer.

Figure 2:
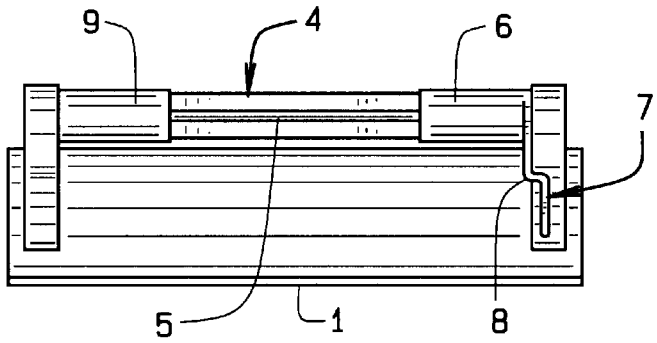
FIG. 2 provides a perspective view of the towel holder, with its roller installed in place intermediate the two end plates of its holder.

FIG. 2 discloses the same towel holder 1, but shows the installation of the towel roll, as at 4, previously installed upon its holder, and in place. As noted, the roller includes a multisectioned component, having an intermediate portion 5, a sleeve 6, at its right segment, and which sleeve includes a lever 7 permanently affixed to its end, and which extends radially outwardly, having a bent portion, as at 8, as noted. The left segment 9 of the roller includes an inner cavity, in which a spring (not shown) is located therein, being a compression spring, and against which the middle section 5 biases, in order to contract the length of the holder 4, when it is being installed, or to release it, and permanently hold it mounted between the end plates 2 and 3, as can be seen.

Figure 3:
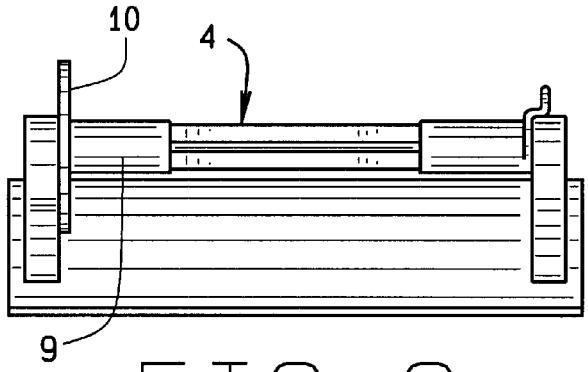
FIG. 3 is a perspective view of the towel holder, with its compressible roller located in place, and having its end supporting disc applied thereon.
Figure 4:
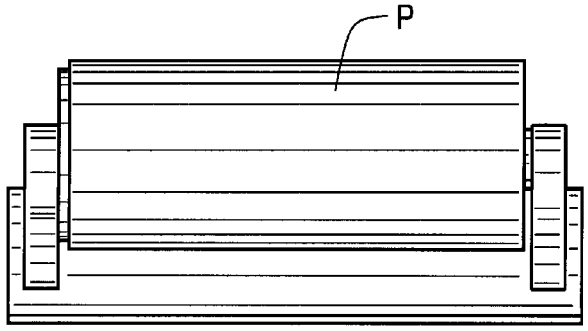
FIG. 4 is a perspective view of the towel holder of this invention, fully assembled and holding a roll of fresh towels thereon.
Figure 5:
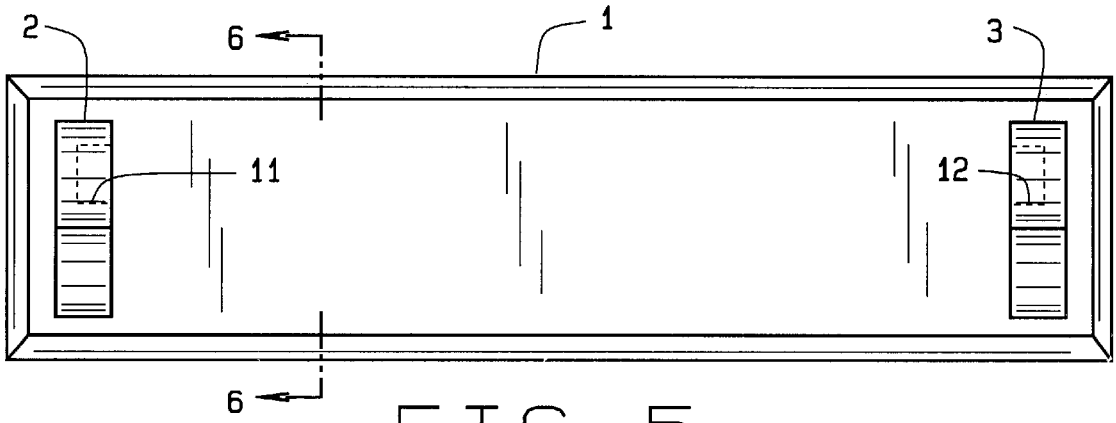
FIG. 5 is a front view of the towel holder of this invention.
Figure 6:
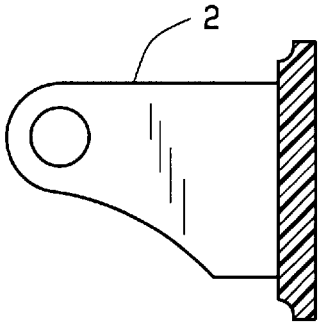
FIG. 6 is a sectional view of the towel holder, showing the interior surface of its left end plate, taken along the line 6—6 of FIG. 5.

Also, proximate the left end of the roller 4, there may be installed a circular disc 10, that is loosely mounted upon the left segment 9 of the roller, and which stabilizes the end of the paper towel, when located upon the paper towel holder of this invention. FIG. 4 discloses the various components for the paper towel holder as previously described in FIGS. 1 through 3, but in this instance, as can be seen, a roll of paper towels, as at P, has been applied, and located in place, for ready usage. As can be noted, the towel holder of this invention may be rested upon its base plate 1, directly upon a countertop, or the base plate 1 may be secured by fasteners to the wall, or held by a double pressure sensitive adhesive means in place, to the wall, or the countertop, when installed.

As can be seen in FIGS. 5 through 8, the various components that fabricate the holder of this invention are shown. The base plate 1 has sufficient length spanning from side to side, and incorporates the end plates 2 and 3 in place, proximate the ends of the base plate, and spaced apart a distance slightly greater than the length of the standard roll of paper towels, so as to provide and facilitate their insertion upon the roller 4, when held in place. As can be seen, each of the end plates 2 and 3 has a counterbore, as at 11 and 12 provided therein, and it is into these counterbores that the paper roller inserts, when installed, for holding a roll of paper towels in place. Obviously, as can also be seen in FIG. 6, the end plates, such as 2, have sufficient width, when extending outwardly from their base plate 1, at least greater than one-half the width of a full roll of paper towels, so that clearance is provided adequately between the back surface of the roll of towels, and the front surface of the base plate 1, when a new roll of towels is installed for usage.

Figure 8:
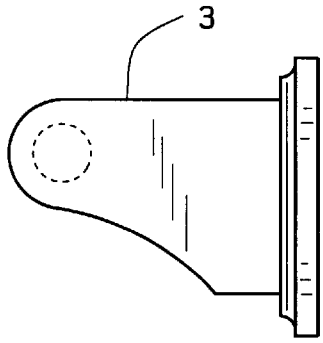
FIG. 8 is a right side view of the towel holder of FIG. 7.
Figure 7:
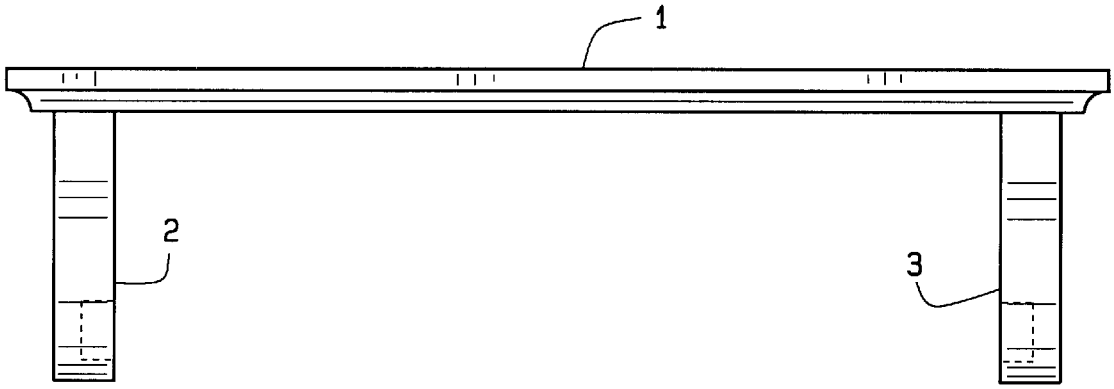
FIG. 7 is a top view of the towel holder of this invention.

FIGS. 7 and 8 show similar dimensional relationships between the base plate 1, the end plates 2 and 3, and the length of the end plate 3, as can be seen.

Figure 9:
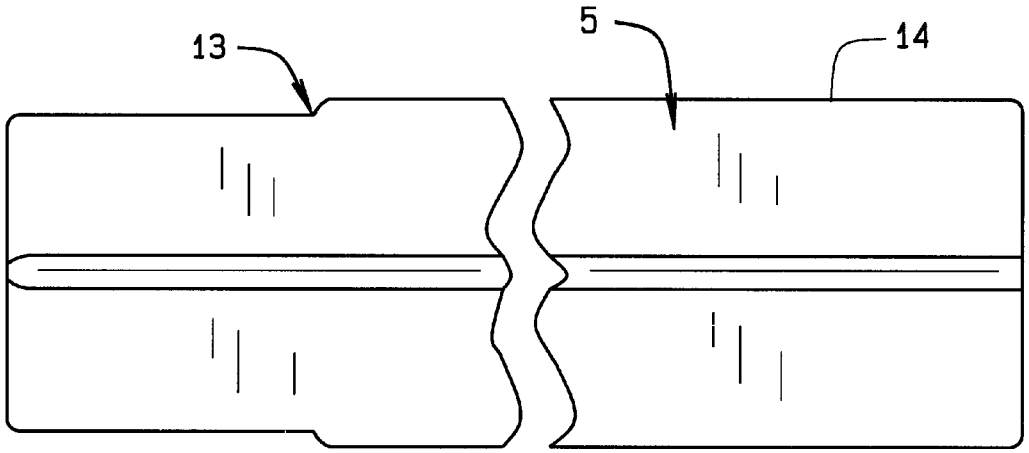
FIG. 9 is a fragmented view of the intermediate section of the towel roller.
Figure 10:
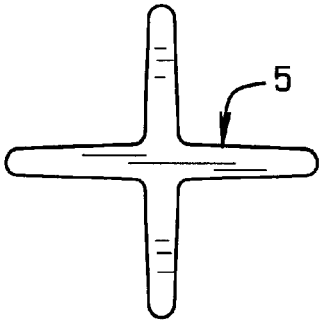
FIG. 10 is a left end view of the roller as shown in FIG. 9.

The paper towel roller, as previously reviewed at 4, is fabricated of a series of sections. As can be seen in FIGS. 9 and 10, the middle section 5 is generally fabricated integrally of a cross-like configuration, in cross-section, as noted in FIG. 10. Its left end is slightly reduced in size, as at 13, so that it can fit within the left segment of the roller, when assembled. The opposite end of the middle section 5 of the roller is slightly enlarged, as at 14, so that it may be pressure fitted within the right segment 6, of the roller, as can be noted in FIG. 2.

Figure 11:
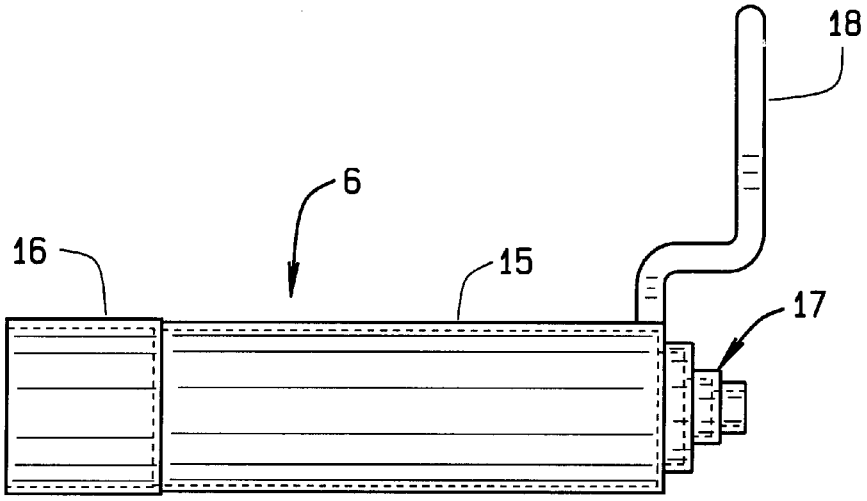
FIG. 11 is a front view of the right side section of the towel roller.
Figure 12:
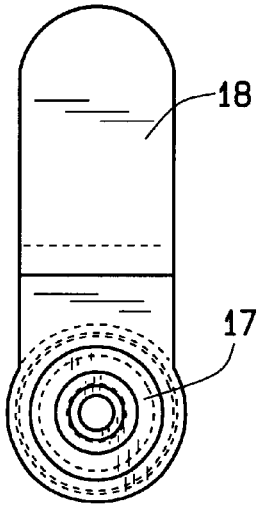
FIG. 12 is a right end view of the section of FIG. 11.

The right segment of the roller is shown in FIGS. 11 and 12. As can be seen, the right segment includes a cylindrical portion 15, which is slightly enlarged at its free end 16, so that the proximate end of the middle segment 5 of the roller, as at 14, can be pressure fitted therein. In addition, the opposite end of the right segment 6 has a series of tiered reduced portions, as at 17, so as to accommodate their locating and pivotally mounting within the counterbore 12 of the proximate end plate 3, when the roller is installed. In addition, there is an integral lever provided at 18, and which has an integral bent configuration at 19, to where it extends for connecting onto the right segment 6, as can be noted, and also to provide adequate clearance for the finger, when one grasps the lever at this location, as when the paper roll is being installed, or removed, as may be desired.

Figure 14:
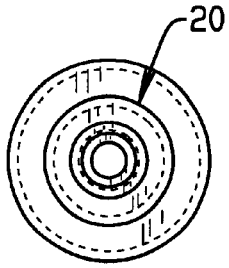
FIG. 14 is a left end view of the section of FIG. 13.
Figure 13:
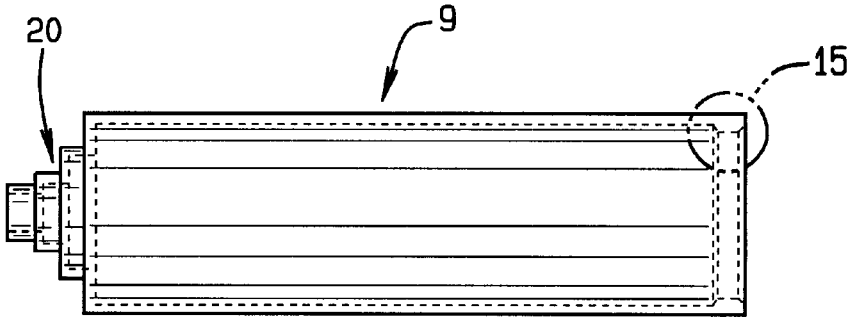
FIG. 13 is a front view of the left section of the towel roller.
Figure 15:
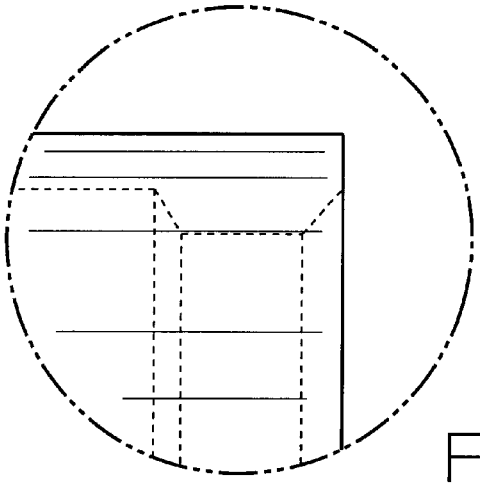
FIG. 15 is an enlarged view of the corner of the section of the towel roller as shown in FIG. 13.

The left segment 9 of the roller is shown in FIGS. 13 through 15, and it is fabricated having a central cavity therein, so that the reduced end 13 of the middle section 5 of the roller can insert therein, and be slid longitudinally with respect thereto, for biasing against a compression spring (not shown), that also locates within the interior of this left section 9 of the roller. It can also be seen that the left section 9, at its end, includes a tiered integral segment 20, that is designed for easily being aligned with and inserting within the counterbore 11 of the end plate 2, at the opposite end of the holder, when the roller is installed in place.

As can be generally understood, when it is desired to add a fresh roll of paper towels to the paper towel holder of this invention, one simply grasps the lever 18, proximate its outer portion, pushes the right segment 6 of the roller to the left, thereby forcing its middle section 5 to urge against the compression spring (not shown), located within the left segment 9, so as to contract or reduce the longitudinal length of the roller, and provide clearance for removal of their tiered ends 17 and 20, respectively, from within the counterbores 12 and 11, of the end plates 2 and 3. Once removed, a fresh roll of paper towels may be located upon the composite roller, the tiered end 20 may be inserted within its respective counterbore 11, of the left end plate 2, the lever 18 will be compressed inwardly, so as to contract the length of the roller 5, providing clearance for the opposite tiered end 17 to pass within the end plate 3, and arrange its tiered end 17 into the counterbore 12, such that when the lever 18 is released, it becomes pivotally mounted therein. Thus, a fresh roll of paper towels will be installed for usage, and can be freely pulled therefrom, since there will be little or no resistance against the turning of paper roll upon its roller 5, when used. Then, after the paper towels have been exhausted, the roller 5 can be removed in a similar manner, by reversing the steps described above, so as to remove the roller from its holder, discard the spent paper towel roll core, and adding a new roll of paper towels thereon, for immediate installation.

Variations or modifications to the subject matter of this invention may occur to those skilled in the art upon reviewing the disclosure as provided herein. Such variations or modifications, if within the spirit of this disclosure, are intended to be encompassed within the scope of the invention as defined.

The description of the preferred embodiment as provided herein, and as depicted in the drawings, is set forth for illustrative purposes only.

I claim:

1. A paper towel holder including a base plate, a pair of end plates, one of each end plate connecting to an end of the base plate, and extending substantially perpendicularly forwardly thereof, each end plate having at least one counter bore provided therein, said counter bores being aligned so as to facilitate the holding of the roller for a paper towel roll thereto, said roller including a three segment roller, said segments comprising an intermediate segment, a left sleeve segment, a right sleeve segment, said left sleeve segment having an internal cavity, spring means mounted within the cavity, the intermediate segment locating partially within the cavity of the left sleeve segment and biasing against said spring means so as to provide a force normally urging said segments apart, said right sleeve segment also having an internal cavity therein, and mounting upon the right end of the intermediate segment, said right sleeve segment having an integral lever extending radially therefrom, said lever, when compressed, reducing the length of the towel roller to provide for insertion and mounting of the roller within the counter bores of the end plates, and upon release of said lever allowing the ends of said roller to revolvingly locate within said end plate counter bores, the free ends of each left and right sleeve segments are reducingly tiered, to facilitate their locating within the counter bores of the end plates when installed, said lever being bent to expose a lever segment at least extending radially from the tiered end of the right sleeve segment so as to furnish clearance for mounting of a paper towel roll thereon during installation, the central segment of the towel roller being formed as a cross design and cross section, and extending substantially into the cavities of the right and left sleeves when the central segment is inserted within the right and left sleeve segments, the end of the cross designed intermediate segment of the towel roller that inserts within the left sleeve segment is of a reduced diameter to accommodate insertion of said segment within the internal cavity of said left sleeve segment, and the right end of the cross designed intermediate segment is of a slightly increased diameter, so as to provide for the snug fit of said intermediate segment within the inner cavity of the right end segment of the towel holder when assembled.

* * * * *